US006378267B1

(12) United States Patent
Bass

(10) Patent No.: US 6,378,267 B1
(45) Date of Patent: Apr. 30, 2002

(54) WINDOW SCREEN INSTALLATION SYSTEM

(76) Inventor: W. Ray Bass, 6701 Sunnyview Rd., Knoxville, TN (US) 37914

( * ) Notice: Subject to any disclaimer, the term of this patent is extended or adjusted under 35 U.S.C. 154(b) by 0 days.

(21) Appl. No.: 09/635,089

(22) Filed: Aug. 8, 2000

(51) Int. Cl.[7] ..... E04C 2/38

(52) U.S. Cl. ..... 52/656.7; 52/222; 52/202; 160/57

(58) Field of Search ..... 160/382, 395, 160/403, 380; 52/656.7, 222, 63

(56) References Cited

U.S. PATENT DOCUMENTS

| | | | | | |
|---|---|---|---|---|---|
| 918,676 | A | | 4/1909 | Johnson | |
| 1,586,708 | A | | 6/1926 | Sandelin | |
| 3,469,695 | A | | 9/1969 | Greeninger | |
| 3,696,857 | A | | 10/1972 | Le Tarte | |
| 3,980,555 | A | | 9/1976 | Freissle | |
| 4,189,880 | A | * | 2/1980 | Ballin | 52/202 |
| 4,234,035 | A | | 11/1980 | Babbs | |
| 4,333,284 | A | * | 6/1982 | Meadows | 52/222 |
| 4,658,522 | A | | 4/1987 | Kramer | |
| 4,690,192 | A | * | 9/1987 | Stilling | 160/57 |
| 5,666,773 | A | | 9/1997 | Librande et al. | |
| 5,904,200 | A | | 5/1999 | Agen | |
| 6,032,433 | A | | 3/2000 | Hatziathanasiou | |

* cited by examiner

*Primary Examiner*—Carl D. Friedman
*Assistant Examiner*—Steve M Varner
(74) *Attorney, Agent, or Firm*—Pitts & Brittian, P.C.

(57) ABSTRACT

A window screen installation system for releasably mounting a screen fabric or other pliable sheet material in such a manner as to self-tighten the fabric or material during installation. Moreover, the screen frame and trim mold are designed to allow for the mounting of the fabric or material without damaging the same such that it may be removed and reused as required. A screen is disposed and held securely in place between a screen frame extrusion member and a trim mold. The screen frame extrusion defines a mounting surface disposed below and parallel to an exterior face. A mounting rib extends along the mounting surface and terminates below the exterior face in the preferred embodiment. A bead is defined at the terminal edge of the mounting rib to serve as a locking mechanism. The trim mold defines a channel opening on the bottom surface thereof to closely receive the mounting rib of the screen frame extrusion. A plurality of retention barbs are formed in the channel to engage the mounting rib bead in order to prevent inadvertent removal of the trim mold from the mounting rib. The screen is laid over the screen frame extrusion at approximately the point to be attached. A first trim mold is then placed over the mounting rib and pressed toward the screen frame extrusion such that the screen is deformed over the mounting rib and the mounting rib and screen are both received within the trim mold channel. After the first trim mold is snapped into place, the opposing trim mold is snapped into place. A similar procedure is then performed on the trim mold on either side of the frame.

8 Claims, 4 Drawing Sheets

WINDOW SCREEN INSTALLATION SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to the field of replaceable window screens. More specifically, the present invention relates to a structure for releasably mounting a screen fabric or other pliable sheet material in a window opening.

2. Description of the Related Art

It is well known that most screens manufactured today include a replaceable screen fabric. In the event the fabric is torn, stretched, or otherwise damaged, the fabric is removed and replaced with another such fabric. Typically this task is accomplished by removing a gasket-type device from within a recess formed around the perimeter of a frame. The gasket retains the fabric edges within the recess such that when the gasket is removed, the fabric is likewise removed. A new fabric is then stretched across the frame and the gasket is replaced within the recess. Excess fabric along the perimeter of the screen—and specifically that material along the perimeter of the fabric and on the side away from the gasket—is then trimmed.

Although this is a simplistic procedure to describe, it is well known that stretching the fabric and maintaining it in a stretched manner while the gasket is replaced is a difficult task. What typically occurs when the appropriate tools are not available is that as the gasket is forced into place, the fabric loosens or is pulled in a direction such as to create wrinkles. Further, due to the tension on the fabric during installation, it is often difficult to force the gasket into the recess without damaging the fabric, or without releasing the tension on the fabric.

Other devices have been produced to provide a window screen construction. Typical of the art are those devices disclosed in the following U.S. Patents:

| Pat. No. | Inventor(s) | Issue Date |
|---|---|---|
| 918,676 | H. W. Johnson | Apr. 20, 1909 |
| 1,586,708 | A. W. Sandelin | June 1, 1926 |
| 3,469,695 | C. D. Greeninger | Sep. 30, 1969 |
| 3,696,857 | F. M. Le Tarte | Oct. 10, 1972 |
| 3,980,555 | M. F. A. Freissle | Sep. 14, 1976 |
| 4,234,035 | F. W. Babbs | Nov. 18, 1980 |
| 4,658,522 | M. L. Kramer | Apr. 21, 1987 |
| 5,666,773 | C. J. Librande et al. | Sep. 16, 1997 |
| 5,904,200 | J. E. Agen | May 18, 1999 |
| 6,032,433 | T. Hatziathanasiou | Mar. 7, 2000 |

Of these patents, the '676 patent issued to Johnson discloses a metal window screen having a metal frame. The interior perimeter of the metal frame defines a bent edge. The screen fabric, or wire netting, is positioned over the frame opening and retaining strips are fastened to the frame over the bent edges, with the wire netting positioned between. The retaining strips are fastened with bolts or screws, the bolts or screws being forced through the netting.

The terminal edge of each retaining strip is deformed into a U-shaped configuration to cooperate with the bent edge of the frame such that as the retaining strip is secured to the frame, the netting is tightened. However, because the netting is damaged during installation, the same cannot be removed and reused as desired.

That device disclosed by Sandelin ('708) is similar to the '676 device in that a retaining frame is screwed onto a screen frame, with a screen fabric disposed therebetween. Similarly, the screen fabric is damaged upon installation by the fasteners.

Greeninger ('695) discloses a screen tightening apparatus for a vibrating screen. Opposing edges of the screen fabric are mounted on a rotating member, each rotating member being provided with a lever to impart rotation thereon. Such an apparatus, while useful in the environment proposed by Greeninger, is impractical in the environment of the present invention. Specifically, the '695 device is impractical for placing a screen over the opening of a window.

The '857 patent issued to Le Tarte discloses a more conventional screen frame wherein a fabric is stretched across an opening in the frame. A plastic, generally Y-shaped, strip is then oriented and pressed into place in the frame such that the edges of the fabric are pressed into a recess defined by the frame, thus holding the fabric in place.

Freissle ('555) discloses a replaceable screen having a frame, but does not disclose a frame having a construction to allow for the replacement of the screen fabric itself.

Babbs ('035) discloses a trim lock for holding the edge of one or two pieces of trim fabric in relation to a frame member of upholstered furniture. Similar to conventional screens, the trim lock is forced into a channel with the trim fabric being disposed between the trim lock and the channel. The '433 device disclosed by Hatziathanasiou is similar to the '035 device disclosed by Babbs.

The '522 device taught by Kramer is used for tensioning a piece of fabric for needlework. A frame defines a circular cross-section, while a plurality of clamps define an arcuate configuration. The clamps are configured to closely receive the frame such that the clamps may pivot over the frame when attached. The fabric is tensioned by so rotating the clamps over the frame. However, Kramer does not disclose a manner in which the fabric is maintained in a tensioned state.

The '773 device disclosed by Librande et al., includes a screen frame to which is releasably mounted a screen. A plurality of rail operators is provided for accomplishing the mounting of the screen on the frame. However, such operators are not disclosed for self-tightening the screen fabric while installing the same on the frame.

Finally, the Agen device ('200) is an improvement to the convention screen installation system, wherein a number of barbs extend inwardly and downwardly in alternating succession on either side of a channel defined by the frame. The screen fabric is inserted into the channel, with the barbs serving to retain the fabric therein. However, as in other conventional screens, there is no provision for self-tightening of the screen fabric as it is installed on the frame.

Therefore, it is an object of this invention to provide a means for installing a screen fabric or other pliable sheet material on a frame in such a manner as to self-tighten as it is installed.

A further object of the present invention is to provide such a means for installing a screen fabric or other pliable material such that the screen fabric may be removed, saved, and reinstalled as necessary.

A still further object of the present invention is to provide such a means whereby the screen fabric or other material is substantially undamaged during installation and removal.

Another object of the present invention is to provide an extrusion for mounting a screen fabric thereon in a removable fashion.

BRIEF SUMMARY OF THE INVENTION

Other objects and advantages will be accomplished by the present invention which is designed for releasably mounting a screen fabric or other pliable sheet material in such a manner as to self-tighten the fabric or material during installation. While a hammer may be used to secure a trim mold to the screen frame, tightening of the screen or fabric is accomplished without the use of any tools. Moreover, in the preferred embodiment the screen frame and trim mold are designed to allow for the mounting of the fabric or material without damaging the same such that it may be removed and reused as required. The present invention is designed to allow for the replacement of the screen fabric with any other suitable sheet material such as vinyl.

A screen is disposed and held securely in place between a screen frame and a trim mold. To accomplish the disposition and retention of the screen, the screen frame and trim mold are each extruded members. The screen frame extrusion defines a mounting surface disposed below and parallel to an exterior face. A vertical surface extends between and perpendicular to the exterior face and the mounting surface. A mounting rib extends along the mounting surface parallel to the vertical surface. The mounting rib terminates below the exterior face in the preferred embodiment. A bead is defined at the terminal edge of the mounting rib to serve as a locking mechanism.

The trim mold is configured to closely receive the mounting rib of the screen frame extrusion. To this extent, the trim mold defines a channel opening on the bottom surface thereof and extending into the trim mold a depth substantially equal to the height of the mounting rib. A plurality of retention barbs disposed at an upward angle with respect to the mounting rib are formed in the channel to engage the mounting rib bead in order to prevent inadvertent removal of the trim mold from the mounting rib. The trim mold is configured to be received within a volume defined generally by the vertical surface and the mounting surface of the screen frame extrusion. The trim mold defines an exterior face which is disposed substantially co-planar with the screen frame extrusion when installed.

In order to install a screen in the screen frame of the present invention, the screen is laid over the screen frame extrusion at approximately the point to be attached. The trim mold is then placed over the mounting rib and pressed toward the screen frame extrusion such that the screen is deformed over the mounting rib and the mounting rib and screen are both received within the trim mold channel. The screen is thus tightly received between the mounting rib and the channel, with the retention barbs assisting in the retention thereof. In order to remove the screen, the trim mold is simply pried away from the screen frame extrusion. After the trim mold is snapped into place, the opposing trim mold is snapped into place. Prior to snapping the trim mold into place, the screen is gently pulled to remove excess slack. A similar procedure is then preformed on the trim mold on either side of the frame.

In a further embodiment of the screen frame of the present invention, the screen frame extrusion defines a symmetrical configuration such as to include opposing mounting ribs. In this embodiment, successive screen panels are installed for uses such as side-by-side windows, screened-in patios, or the like.

BRIEF DESCRIPTION OF THE SEVERAL VIEWS OF THE DRAWINGS

The above mentioned features of the invention will become more clearly understood from the following detailed description of the invention read together with the drawings in which.

DETAILED DESCRIPTION OF THE INVENTION

A window screen installation system incorporating various features of the present invention is illustrated generally at 10 in the figures. The window screen installation system 10, which comprises primarily includes a screen frame 12 and trim mold 14, is designed for releasably mounting a screen fabric 16 or other pliable sheet material in such a manner as to self-tighten the fabric or material during installation. While a hammer may be used to secure the trim mold 14 to the screen frame 12, tightening of the screen or fabric 16 is accomplished without the use of any tools. Moreover, in the preferred embodiment the screen frame 12 and trim mold 14 are designed to allow for the mounting of the screen or fabric 16 without damaging the same such that it may be removed and reused as required.

In the preferred embodiment of the present invention, a screen fabric 16 may be installed for use in such applications as a storm door or a window screen, or for larger applications such as screened-in porches. However, in colder seasons, it may be preferable to replace the screen fabric 16 with a transparent sheet material 16' such as vinyl. Accordingly, the present invention is designed to allow for the replacement of the screen fabric 16 with the sheet material 16', and vise versa. For ease of description, use of the term "screen 16" is intended to include a conventional screen fabric 16, a conventional transparent sheet material 16', or any other pliable sheet that may be used as a membrane in the screen frame 12 of the present invention.

Figure 1:
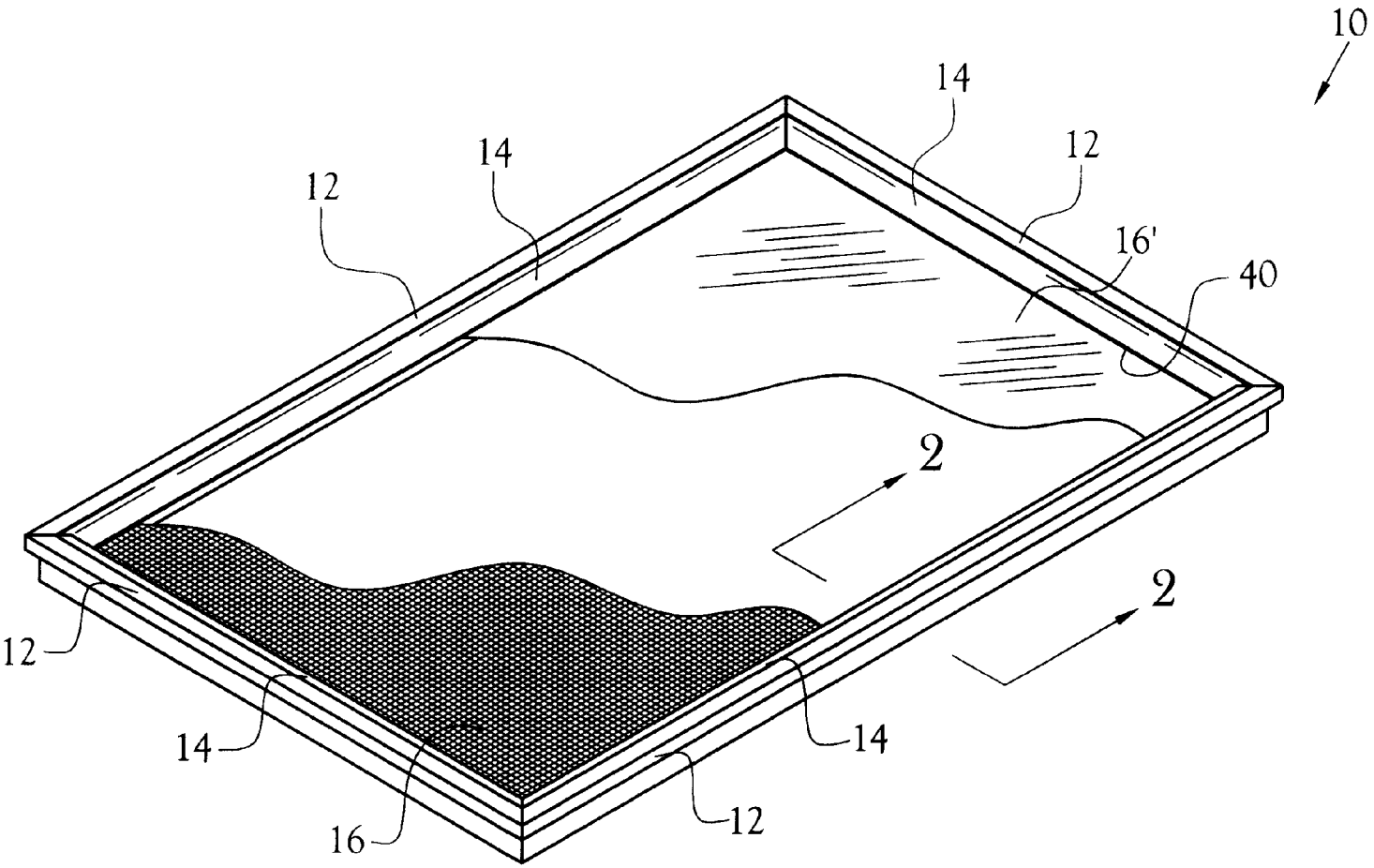
FIG. 1 is a perspective view of the window screen installation system constructed in accordance with several features of the present invention showing a frame having a section of screen fabric mounted therein, as well as a section of transparent material, thereby illustrating alternate uses of the present invention.

Illustrated in FIG. 1 is a perspective view of a screen frame 12 of the present invention. In order to illustrate the various uses of the screen frame 12, a portion of a screen fabric 16 is shown in the lower portion of the frame 12, while a portion of a transparent sheet material 16' is shown in the upper portion of the screen frame 12. Thus it is clearly seen that the screen frame 12 and trim mold 14 of the present invention are designed for use in various environments and applications.

Figure 2:
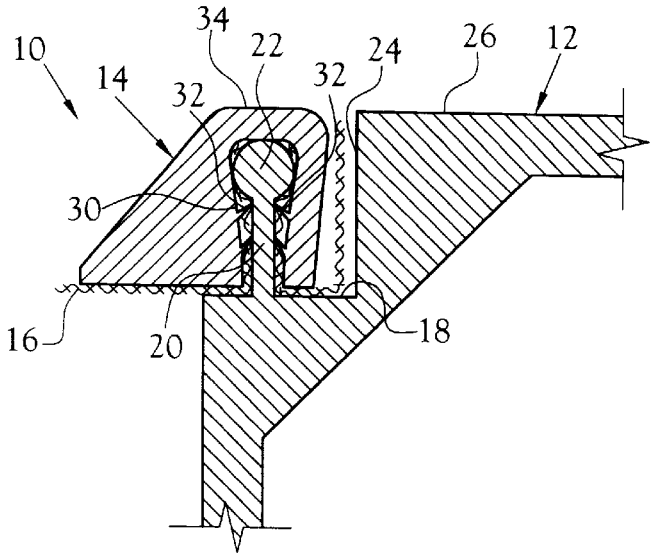
FIG. 2 is an elevation view, in section, of the window screen installation system taken at 2—2 of FIG. 1.

As more clearly illustrated in FIG. 2, the screen 16 is disposed and held securely in place between the screen frame 12 and the trim mold 14. To accomplish the disposition and retention of the screen 16, the screen frame 12 and trim mold 14 are each extruded members. The s screen frame extrusion 12 defines a mounting surface 18 preferably disposed below and parallel to an exterior face 26. A vertical surface 24 extends between and perpendicular to the exterior face 26 and the mounting surface 18. A mounting rib 20 extends along the mounting surface 18 and parallel to the vertical surface 24. The mounting rib 20 terminates below the exterior face 26 in the preferred embodiment. A bead 22 is defined at the terminal edge of the mounting rib 20 to serve as a locking mechanism.

The trim mold 14 is configured to closely receive the mounting rib 20 of the screen frame extrusion 12. To this extent, the trim mold 14 defines a channel 30 opening on the bottom surface thereof and extending into the trim mold 14 a depth substantially equal to the height of the mounting rib 20. A plurality of retention barbs 32 disposed at an upward angle with respect to the mounting rib 20 are formed in the channel 30 to engage the mounting rib 20 bead in order to prevent inadvertent removal of the trim mold 14 from the mounting rib 20.

Further, the trim mold 14 is configured to be received within a volume defined generally by the vertical surface 24 and the mounting surface 18 of the screen frame extrusion 12. In the preferred embodiment, the trim mold 14 defines an exterior face 34 which is disposed substantially co-planar with the screen frame extrusion 12 when installed. Such disposition is accomplished by equating the thickness of the trim mold 14 from the extent of the channel 30 to the trim mold exterior face 34 with the difference in the height of the screen frame extrusion vertical surface 24 less the height of the mounting rib 20 and bead 22. In the preferred embodiment, as described, the height of the mounting rib 20 and bead 22 and the depth of the channel 30 are substantially equal. Accordingly, in order to accomplish the co-planar relationship of the screen frame extrusion exterior face 26 and the trim mold exterior face 34, the overall height of the trim mold 14 is substantially equal to the height of the screen frame extrusion vertical surface 24. However, it will be understood by one skilled in the art that other configurations may be as suitable in particular applications.

In order to install a screen 16 in the screen frame 12 of the present invention, the screen 16 is laid over the screen frame extrusion 12 at approximately the point to be attached. The trim mold 14 is then placed over the mounting rib 20 and pressed toward the screen frame extrusion 12 such that the screen 16 is deformed over the mounting rib 20 and the mounting rib 20 and screen 16 are both received within the trim mold channel 30. The screen 16 is thus tightly received between the mounting rib 20 and the channel 30, with the retention barbs 32 assisting in the retention thereof. In order to remove the screen 16, the trim mold 14 is simply pried away from the screen frame extrusion 12 with, for example, a flat head screwdriver. Thus, mounting and removal of the screen 16 typically do not damage the screen 16 as a result of not requiring the use of conventional fasteners such as screws.

Figure 6:
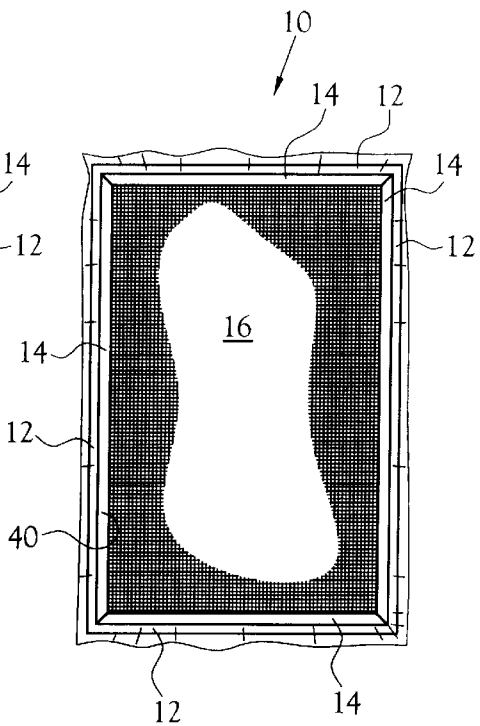
FIG. 6 is a top plan view of the window screen installation screen showing a fourth trim rail mounted thereon.
Figure 5:
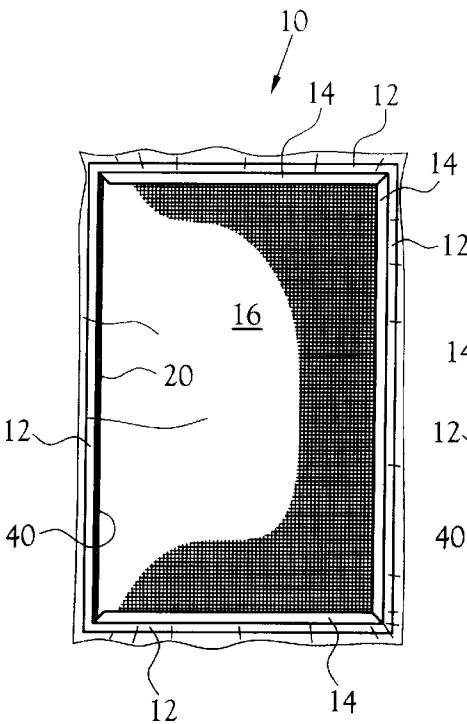
FIG. 5 is a top plan view of the window screen installation screen showing a third trim rail mounted thereon.
Figure 4:
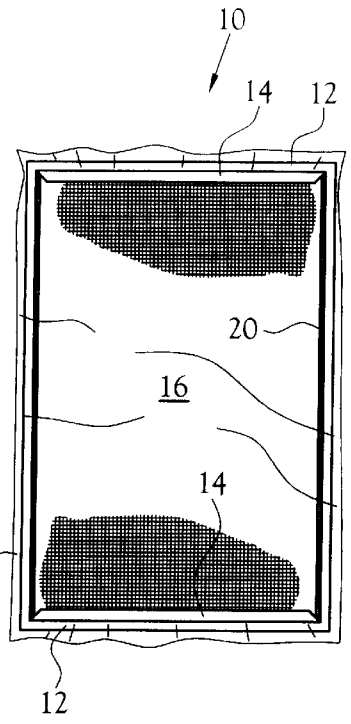
FIG. 4 is a top plan view of the window screen installation screen showing a second trim rail mounted thereon.
Figure 3:
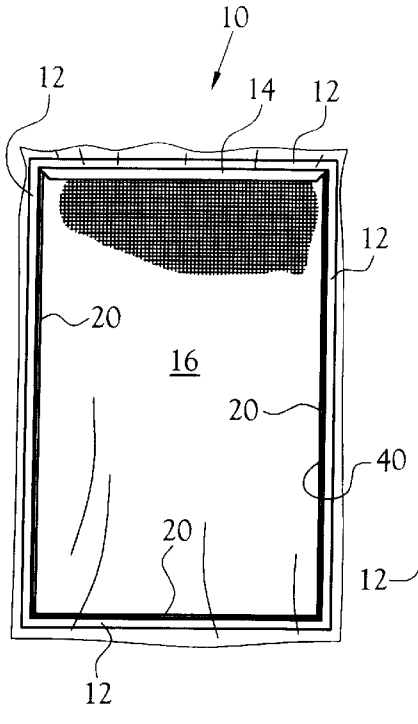
FIG. 3 is a top plan view of the window screen installation screen showing a first trim rail mounted thereon.

FIGS. 3–6 illustrate in a step-by-step fashion the installation of a screen 16 on a screen frame 12. As illustrated in FIG. 3, a screen 16 dimensioned at least slightly larger than the opening 40 defined by the screen frame 12 is positioned on top of the screen frame 12 and the trim mold 14 corresponding to a first screen frame extrusion 12 is snapped into place. Then as illustrated in FIG. 4, the opposing trim mold 14 is snapped into place. Prior to snapping the trim mold 14 into place, the screen 16 is gently pulled to remove excess slack. However, slack approximately equal to the height of the mounting rib 20 is automatically removed from the screen 16 when the second trim mold 14 is placed. By placing opposing trim molds 14 in this manner, slack is removed from the screen 16 in an end-to-end fashion, with some slack remaining side-to-side. FIGS. 5 and 6 illustrate a similar procedure from side to side to remove the remaining slack and to complete the screen mounting process. With the placement of each of the third and fourth trim molds 14, slack approximately equal to the height of the mounting rib 20 is taken from each side of the screen 16, leaving a tightened screen mounted on the screen frame 12.

Figure 8:
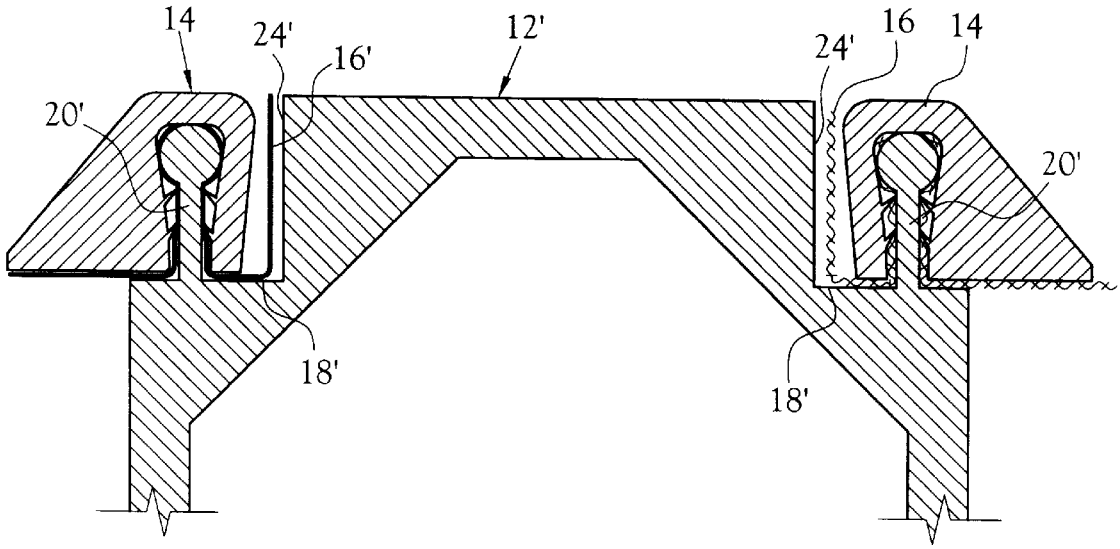
FIG. 8 is an elevation view, in section, of the window screen installation system taken at 8—8 of FIG. 7.
Figure 7:
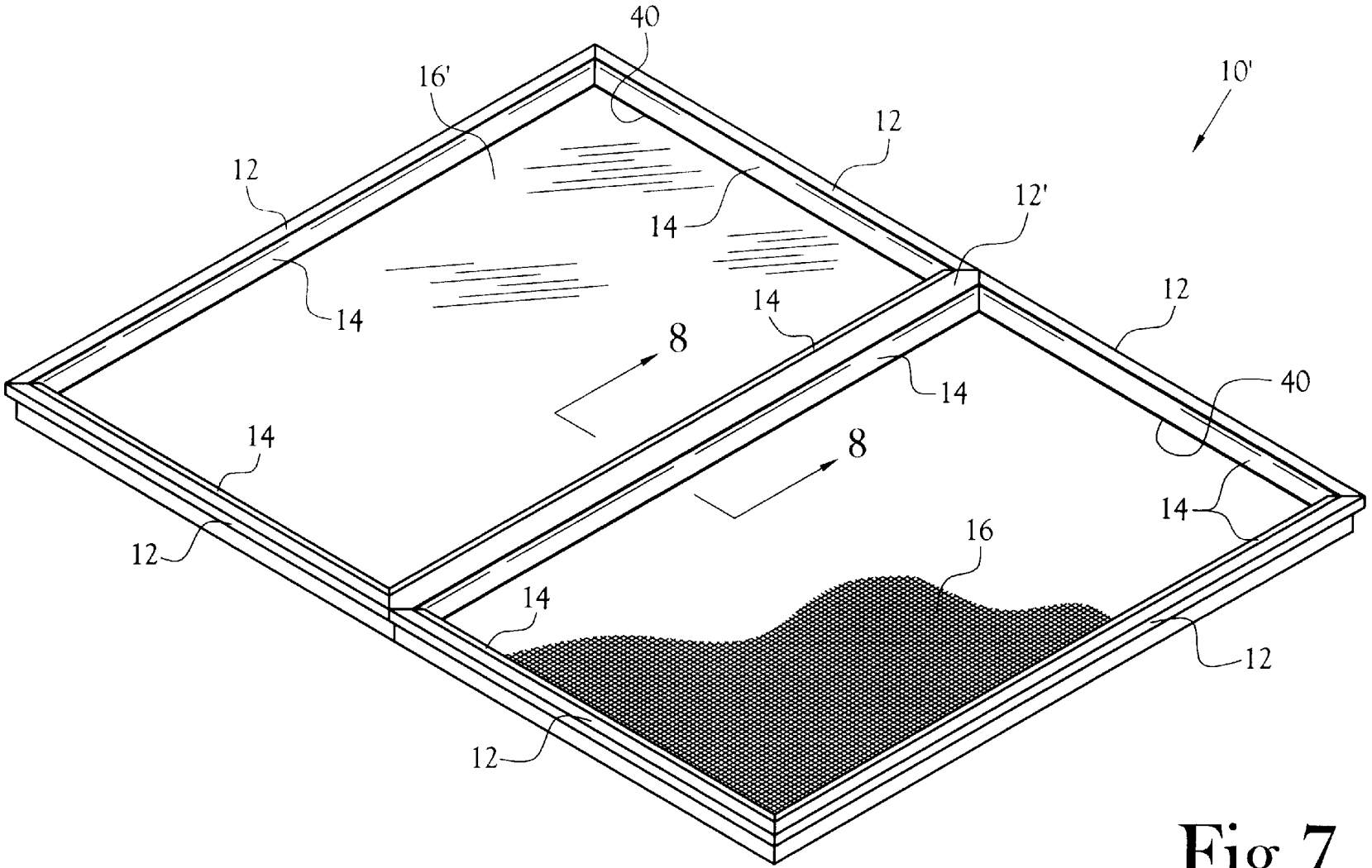
FIG. 7 is a perspective view of an alternate embodiment of the frame rail of the window screen installation system constructed in accordance with several features of the present invention, further showing a frame having a panel of screen fabric mounted therein, as well as a panel of transparent material, thereby illustrating alternate uses of the present invention.

FIGS. 7 and 8 illustrate generally a further embodiment of the screen frame 10' of the present invention wherein the screen frame extrusion 12' defines a symmetrical configuration such as to include opposing mounting ribs 20'. In this embodiment, as illustrated in FIG. 7, successive screen panels 16 are installed for uses such as side-by-side windows, screened-in patios, or the like. Illustrated for purposes of clarifying a variety of uses of the screen frame 10' of the present invention, one panel is shown to be a screen fabric 16, while the other panel is shown to be a transparent material 16' such as vinyl.

As best illustrated in FIG. 8, the screen frame extrusion 12' defines opposing vertical surfaces 24', mounting surfaces 18' and mounting ribs 20'. Each, however, functions in similar fashion to that of the previously described embodiment.

From the foregoing description, it will be recognized by those skilled in the art that a window screen installation system offering advantages over the prior art has been provided. Specifically, the window screen installation system is designed for releasably mounting a screen fabric or other pliable sheet material in such a manner as to self-tighten the fabric or material during installation. Tightening of the screen or fabric is accomplished without the use of any tools. Moreover, the screen frame is designed to allow for the mounting of the fabric or material without damaging the same such that it may be removed and reused as required.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A window screen installation system comprising:

a screen frame constructed from at least one screen frame extrusion, each said screen frame extrusion cooperating to form an opening across which is positioned a screen, each said screen frame extrusion defining at least one mounting surface and at least one mounting rib extending upwardly from said mounting surface and parallel to an interior edge of said screen frame extrusion, said mounting rib defining a bead along a terminal edge of said mounting rib, said screen frame extrusion further defining an exterior face above and parallel to said mounting surface, and a vertical surface extending between and perpendicular to said exterior face and said mounting surface, whereby said mounting rib is disposed substantially parallel to said vertical surface, and whereby said mounting rib terminates below said exterior face; and a trim mold configured to closely receive said mounting rib of said screen frame extrusion said screen, said trim mold defining a bottom surface and a channel opening thereon and extending into said trim mold a depth substantially equal to a height of said mounting rib, said channel defining a plurality of retention barbs for engaging said mounting rib bead, whereby said trim mold is prevented from inadvertent removal when said screen frame extrusion mounting rib is received within said trim mold channel and said screen is retained from movement therein, and further whereby said screen is self-tightened as said trim mold is engaged with said screen frame extrusion.

2. The window screen installation system of claim 1 wherein said trim mold further defines an exterior face disposed substantially co-planar with said screen frame extrusion exterior face when said screen frame extrusion mounting rib is received within said trim mold channel.

3. The window screen installation system of claim 1 wherein said screen frame extrusion defines a symmetrical configuration having a first said mounting rib for mounting a first said screen and a second said mounting rib for mounting a second said screen.

4. The window screen installation system of claim 1 wherein said screen is fabricated from a mesh-type screen selected to allow air flow therethrough.

5. The window screen installation system of claim 1 wherein said screen is fabricated from a sheet material selected to prevent airflow therethrough.

6. The window screen installation system of claim 1 wherein said screen is interchangeable and is fabricated from either of a mesh-type screen selected to allow air flow therethrough and a sheet material selected to prevent airflow therethrough.

7. A method for installing a screen on a screen frame assembly, said screen frame assembly including a screen frame and at least one trim mold, said screen frame constructed from at least one screen frame extrusion, each said screen frame extrusion cooperating to form an opening across which is positioned said screen, each said screen frame extrusion defining at least one mounting surface and at least one mounting rib extending upwardly from said mounting surface and parallel to an interior edge of said screen frame extrusion, said mounting rib defining a bead along a terminal edge of said mounting rib, said screen frame extrusion further defining an exterior face above and parallel to said mounting surface, and a vertical surface extending between and perpendicular to said exterior face and said mounting surface, whereby said mounting rib is disposed substantially parallel to said vertical surface, and whereby said mounting rib terminates below said exterior face, said trim mold being configured to closely receive said mounting rib of said screen frame extrusion said screen, said trim mold defining a bottom surface and a channel opening thereon and extending into said trim mold a depth substantially equal to a height of said mounting rib, said channel defining a plurality of retention barbs for engaging said mounting rib bead, said method comprises the steps of:

a) positioning said screen over said opening defined by said screen frame;

b) placing a one of said at least one trim mold over said mounting rib of a cooperating one of said at least one screen frame extrusion to position said channel over said mounting rib;

c) pressing said of mold to engage said mounting rib in said channel with said screen positioned between;

d) pulling said screen to gently tighten said screen over said screen frame opening;

e) placing a further of said at least one trim mold over said mounting rib of a cooperating one of said at least one screen frame extrusion to position said channel over said mounting rib;

f) pressing said further trim mold to engage said mounting rib in said channel with said screen positioned between;

g) repeating steps d) through f) until each of said at least one trim mold has been pressed into engagement with a cooperating one of each of said at least one screen frame extrusion mounting rib, whereby as said further of said at least one trim mold and each subsequent said at least one trim mold is engaged, said screen is self-tightened.

8. The method of claim 7, after said step of repeating steps d) through f), further comprising the step of:

h) trimming excess of said screen from around an exterior perimeter defined by each of said at least one trim mold.

* * * * *